US007722442B2

(12) United States Patent
Jones

(10) Patent No.: US 7,722,442 B2
(45) Date of Patent: May 25, 2010

(54) KNIFE-EDGE SHARPENING APPARATUS

(75) Inventor: Todd Jones, El Cajon, CA (US)

(73) Assignee: GT Knives, Inc., San Diego, CA (US)

( * ) Notice: Subject to any disclaimer, the term of this patent is extended or adjusted under 35 U.S.C. 154(b) by 0 days.

(21) Appl. No.: 10/422,319

(22) Filed: Apr. 23, 2003

(65) Prior Publication Data

US 2003/0194958 A1 Oct. 16, 2003

(51) Int. Cl.
*B24B 3/58* (2006.01)

(52) U.S. Cl. ..... 451/192; 451/547

(58) Field of Classification Search ..... 451/190–194, 451/541–542, 547–548, 45, 198, 203, 206, 451/349, 208; 76/82, 86, 87, 88
See application file for complete search history.

(56) References Cited

U.S. PATENT DOCUMENTS 1,699,510 A * 1/1929 Gaisman et al. ..... 451/207
1,918,111 A 7/1933 Kohlmiller
2,404,025 A * 7/1946 Barnes ..... 76/86
2,707,852 A 5/1955 Fillweber
2,709,874 A * 6/1955 Delafontaine ..... 451/190
3,484,997 A 12/1969 Allen
3,494,081 A 2/1970 Taylor et al.
3,758,993 A * 9/1973 Kirtz ..... 451/194
3,814,962 A * 6/1974 Baermann ..... 310/103
4,265,055 A 5/1981 Cartwright et al.

* cited by examiner

*Primary Examiner*—Robert Rose
(74) *Attorney, Agent, or Firm*—Thomas J. Tighe, Esq.

(57) ABSTRACT

Two counter-rotating, intermeshing, toothed wheels grind opposite sides of an interposed blade to create or burrlessly sharpen a knife-edge on the blade. The wheels can be solid or comprised of a fixed stack of toothed disks, concentrically aligned, the teeth of each succeeding disk angularly offset in a common direction from the teeth of the next preceding disk to create a wheel having a plurality of uniform, elongated composite teeth around the circumference of the stack, the teeth being angled from the wheel's axis. Two such wheels, one with teeth angled in an opposite direction, can be counter-rotated and because of the oppositely angled teeth, are capable of intermeshing. The degree of intermeshing can be selectively varied to correspondingly vary the sharpening angle. The apex ridges of both the solid and composite teeth can be selectively profiled to sharpen non-uniformly, e.g. serrating a blade edge.

22 Claims, 6 Drawing Sheets

KNIFE-EDGE SHARPENING APPARATUS

This invention claims the benefits of provisional application Ser. No. 60/173,848, filed on Dec. 30, 1999 and non-provisional application Ser. No. 09/746,331, filed on Dec. 22, 2000.

BACKGROUND OF THE INVENTION

This invention relates in general to the field of apparatuses for sharpening knives and other cutting blades, and more particularly to counter-rotating wheels having intermeshing teeth for sharpening blades.

Blade sharpening is, of course, quite old and there have been many improvements in the methods and devices used for forming a knife-edge on a blade. Heretofore, a problem with sharpening a blade has been the time that it takes to grind and hone the blade to achieve a satisfactory sharpness. Also, with conventional sharpening equipment and methods, a burr is left on the edge when the blade is ground. This burr can be honed or polished off, but this requires an additional operation, time and effort. Sharpening equipment has evolved from files and polishing stones, to grinding and polishing wheels, to combinations of such wheels, to intermeshing worm gears.

This invention makes sharpening a blade fast and easy, without a burr. An extremely sharp edge can be formed suitable for surgical instruments.

Other advantages and attributes of this invention will be readily discernable upon a reading of the text hereinafter.

SUMMARY OF THE INVENTION

An object of this invention is to provide a blade sharpening wheel comprising a plurality of concentrically stacked disks, each having a plurality of radial grinding teeth spaced around its circumference.

An additional object of this invention is to provide a sharpening wheel as described above in which the disks are in angular offset relation to each other.

An additional object of this invention is to provide a sharpening wheel as described above in which each disk has a plurality of radial teeth uniformly spaced around its circumference, the disks being aligned concentrically but progressively angularly offset one from another.

An additional object of this invention is to provide a layered sharpening wheel, each layer having a uniform number of circumferential grinding teeth uniformly spaced apart, the teeth of all the layers being aligned in rows which are angled with respect to the wheel's axis.

An additional object of this invention is to provide a sharpening wheel as described in the preceding paragraph in which there is no axial gap between the tail end of a row of teeth and the front end of a preceding row of teeth.

An additional object of this invention is to provide a sharpening wheel as described above in which a coating, e.g. by cubic boron nitride, is adhered to the apexes of the teeth to enhance their cutting ability.

An additional object of this invention is to provide a sharpening wheel as described above in which the cutting ability of the apexes of the teeth is enhanced by an adhered coating, e.g. cubic boron nitride.

An additional object of this invention is to provide a sharpening wheel as described above but in which the lengths of the teeth are not uniform.

An additional object of this invention is to provide a sharpening wheel, as described above, in which the apexes of each row of teeth define are selectively non-linear, e.g. sloping or curved.

An additional object of this invention is to provide a pair of intermeshing, counter-rotating, toothed wheels for sharpening blades.

An additional object of this invention is to provide a first sharpening wheel consisting of a plurality of stacked disks in which each disk, after the first, is concentrically stacked at an angular offset from a preceding disk, the offsets being in one direction; and a second sharpening wheel in which each disk, after the first, is concentrically stacked at an angular offset from a preceding disk but in an offset direction opposite from the first wheel.

An additional object of this invention is to provide a first and a second sharpening wheel having teeth which intermesh when the wheels, aligned radially, are affixed on counter-rotating axles of a sharpening device.

An additional object of this invention is to provide intermeshing sharpening wheels as described above wherein the amount the wheels' mesh is selectable over a range.

An additional object of this invention is to provide intermeshing sharpening wheels which can vary, within a range, the included angle of the sharpened edge of a blade.

An additional object of this invention is to provide intermeshing sharpening wheels as described above wherein the lengths of the teeth of the wheels are such that in cooperation they can sharpen a blade in serrated fashion.

An additional object of this invention is to provide a solid sharpening wheel having a plurality of spaced grinding teeth radially projecting from the wheel's circumferential edge, the teeth being elongated axially.

An additional object of this invention is to provide a solid sharpening wheel as described above wherein the teeth are angled with respect to the wheel's axis.

An additional object of this invention is to provide a solid sharpening wheel as described above wherein each tooth has a leading edge and a trailing edge.

An additional object of this invention is to provide a solid sharpening wheel as described in the preceding paragraph in which there is no circumferential gap, in the axial direction, between a leading edge of one tooth and the trailing edge of the next adjacent tooth.

A further object of this invention is to provide a solid sharpening wheel as described above for use, in similar fashion to the sharpening wheels formed from the above-described stacked wheels.

These objects, and other objects expressed or implied in this document, are accomplished by the invention described herein.

The sharpening wheels of one preferred embodiment of this invention are assembled from a stack of a plurality of layers of individual gear-shaped, toothed disks. Each layer, after the first, is slightly offset angularly from the preceding layer in a set direction. The stack thus forms a gear-shaped wheel having composite teeth which are angled from the axis of the wheel. Alternatively, the wheel can be one solid disk having axially elongated teeth which are angled from the axis of the wheel. In either case, a mating wheel has teeth angled in the opposite direction so the two wheels can mesh edgewise. For the stacked wheel, with the layers fixed in position, a coating, such as cubic boron nitride, is applied to at least the apexes of the teeth to enable the teeth to finely grind the edge of a blade. Cubic boron nitride is also preferably applied to at least the apex ridge of the teeth of the solid wheel. Two mating wheels, each with its teeth aligned in different directions are affixed to counter-rotatable shafts of a sharpening device. The shafts are positioned to allow the teeth on the wheels to intermesh when the shafts are rotated. A blade drawn generally parallel to the shafts, along the line of the bottom of the trough between the two counter-rotating wheels, where the teeth exit their intermeshed alignment, will be ground by the teeth to a fine edge. By adjusting the degree of intermeshing, the angle of the edge ground on the blade can be varied. The grinding action of the wheels sharpens the blade without leaving a burr.

DESCRIPTION OF THE PREFERRED EMBODIMENT

Figure 1:
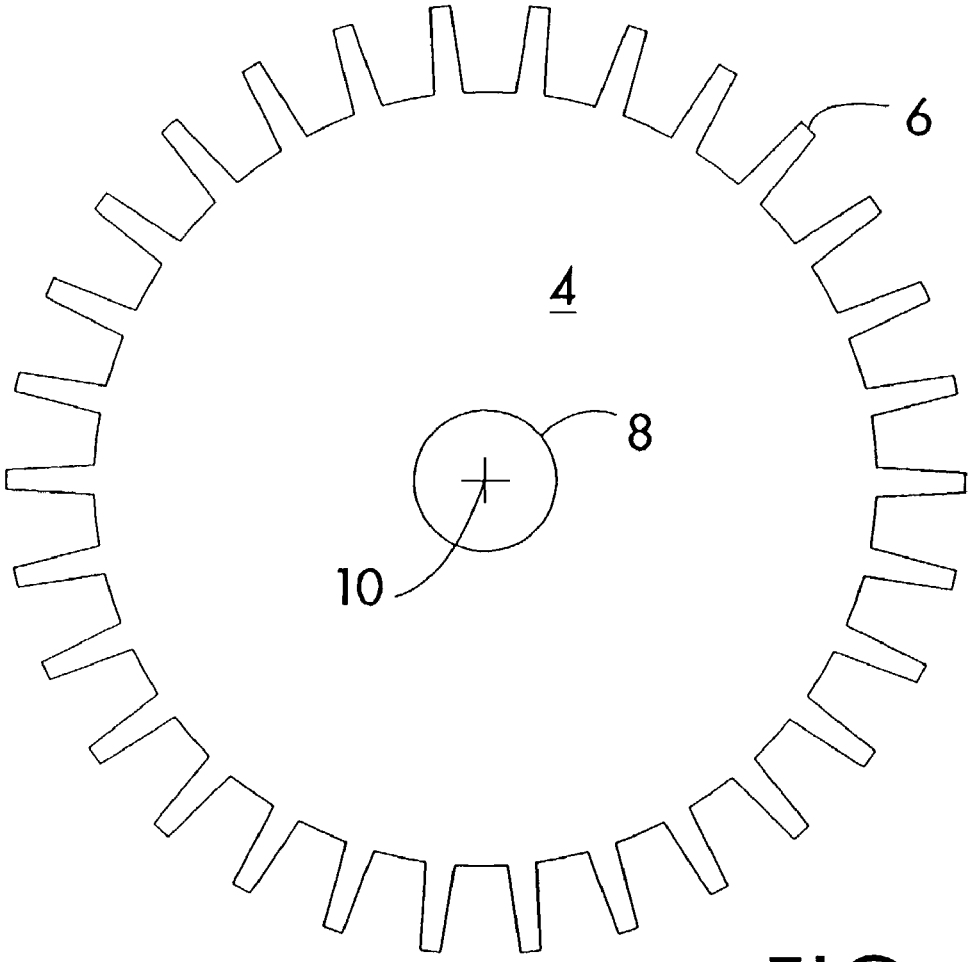
FIG. 1 is a front elevational view of one of a plurality of toothed disks concentrically stacked and progressively angularly offset to form the wheel illustrated in FIG. 2.
Figure 2:
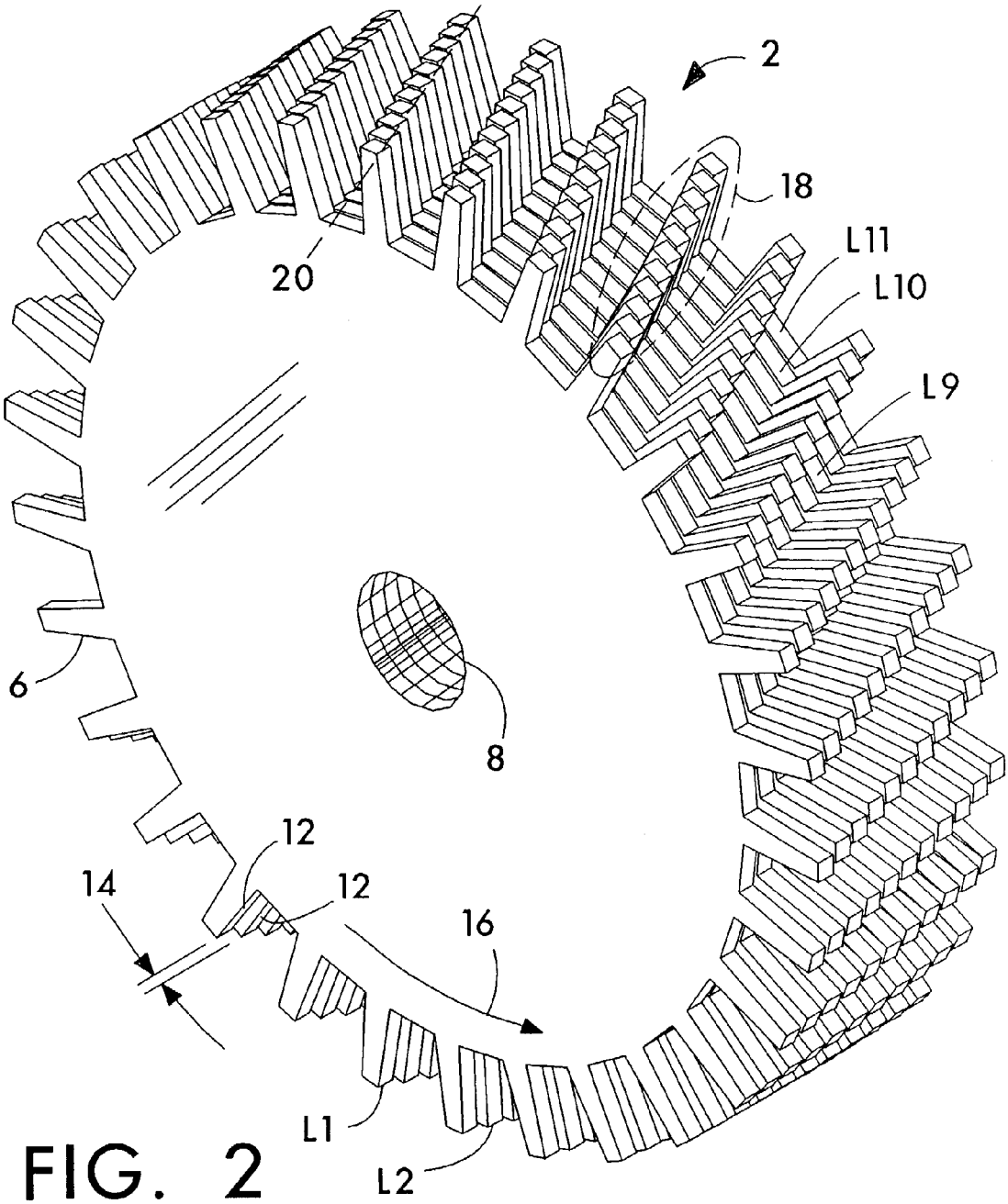
FIG. 2 is a pictorial view of a first embodiment of a sharpening wheel according to this invention.

Referring to FIGS. 1 and 2, a sharpening wheel of the invention, generally designated 2, is illustrated to be an assemblage of a plurality of circumferentially toothed disks 4, the disks being concentrically aligned in stacked relation. Each disk is circular, has a plurality of radial teeth 6 uniformly spaced around the disk's circumference, and defines a mounting hole 8 concentric with an axis 10 of the disk. The disks, except as noted below for other embodiments, are preferably uniform having the same dimensions and number of teeth.

Figure 3A:
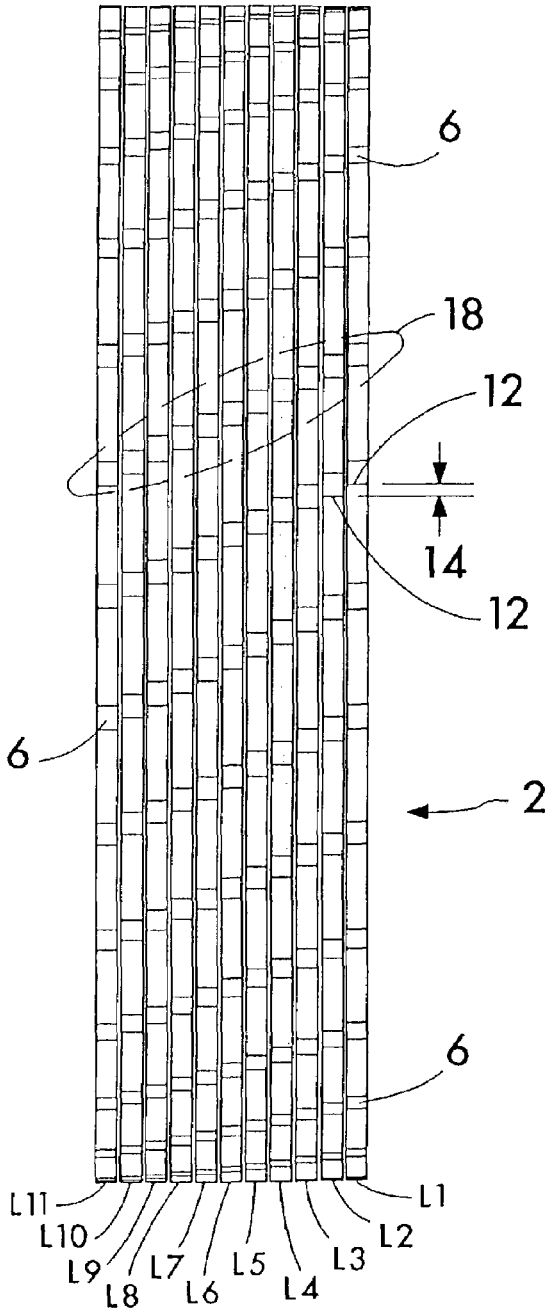
FIG. 3A is an edge elevational view of the sharpening wheel of FIG. 2, lateral lines other than those defining the tips of the teeth of the disks having been removed for clarity.

Referring to FIGS. 2 and 3A, the disks are stacked adjacent each other and aligned along their axes forming a plurality of layers. Preferably eleven layers, L1 through L11, are used to assemble a sharpening wheel. Following the first layer L1, each succeeding layer, i.e. disk, is angularly offset in a certain amount in a common direction from an immediately preceding disk. As illustrated, starting from an edge 12 of a tooth on a disk in the first layer L1, a corresponding edge 12 of a matching tooth in the second layer L2 is offset a certain angular amount 14 in the direction of arrow 16. In the preferred embodiment, each successive layer (L3 through L11) is offset the same amount 14 and in the same common direction 16 from its immediately preceding layer. This arrangement creates a sharpening wheel having a plurality of "composite" teeth 18 each consisting of a queue of adjacent but offset teeth 6, one tooth from each layer. In the preferred embodiment, the long axes of the composite teeth are uniformly angular with respect to the wheel's axis. Each composite tooth, 18 or 30, has a leading, jagged edge 20 across its length defined by the leading edges of the apexes of the teeth 6 in its queue. These leading edges are in relation to the direction of rotation 34 shown in FIGS. 4A and 4B. the direction of rotation in this case being opposite to the offset direction 16, but both the offset direction and the direction of rotation could be the same. The composite teeth would be sloped in the opposite direction. The direction of rotation determines which edge of the composite tooth is the leading edge. In operation, these jagged edges machine the blade being operated-on to efficiently and precisely sharpen it.

Figure 3B:
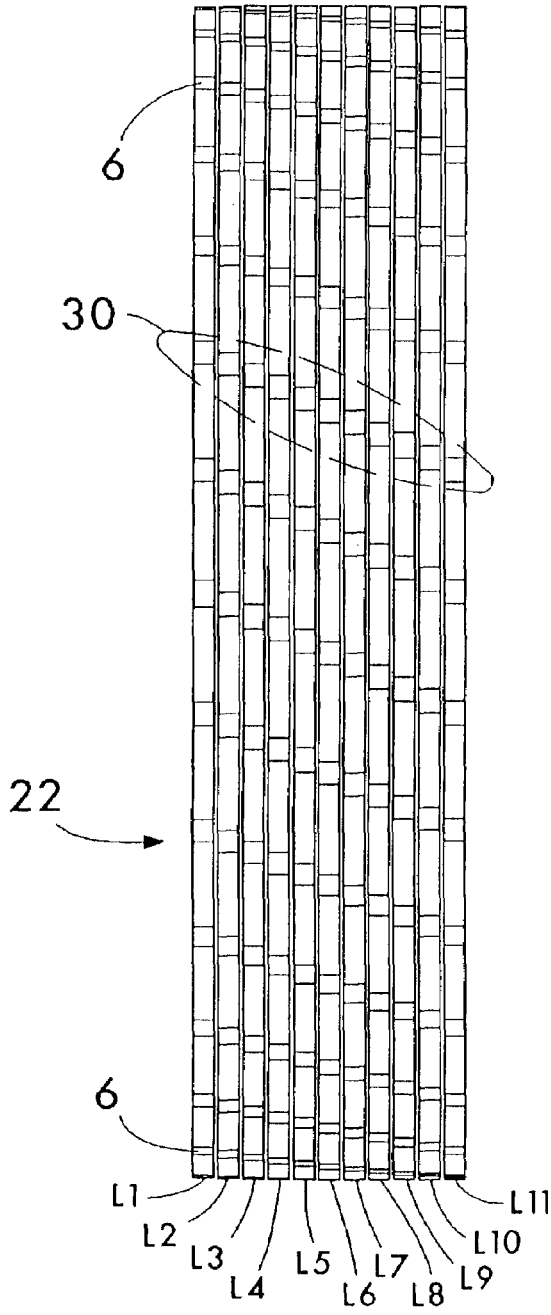
FIG. 3B is an edge elevational view of a sharpening wheel identical to that of FIG. 2 except that its stacked disks are progressively angularly offset in an opposite direction, lateral lines other than those defining the tips of the teeth of the disks having been removed for clarity.
Figure 4A:
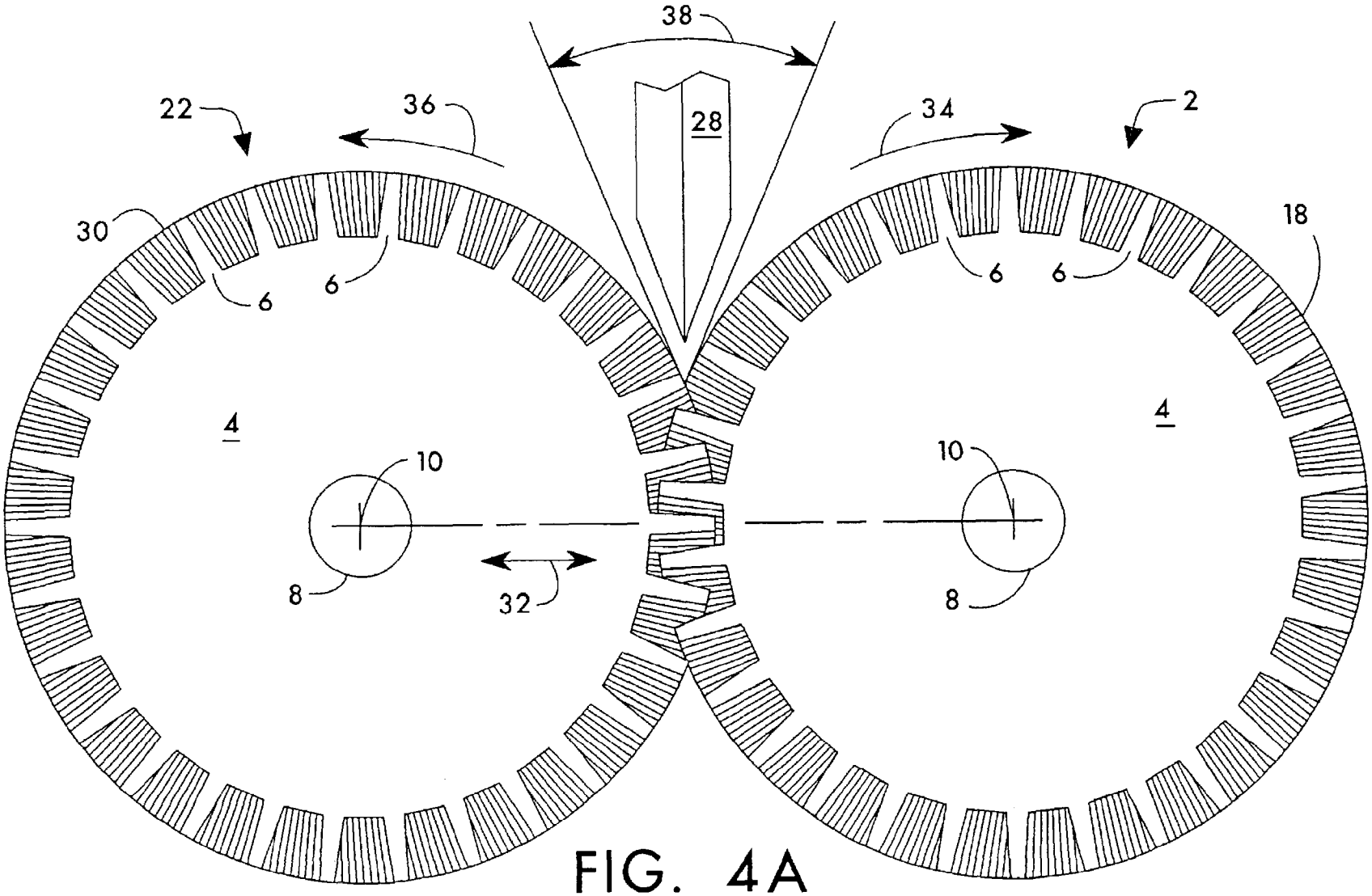
FIGS. 4A and 4B are each a front elevational view of the sharpening wheels of FIGS. 3A and 3B mounted on respective parallel, oppositely rotating axles, the axles in FIG. 4A being closer together than the axles in FIG. 4B for a larger sharpening angle.
Figure 4B:
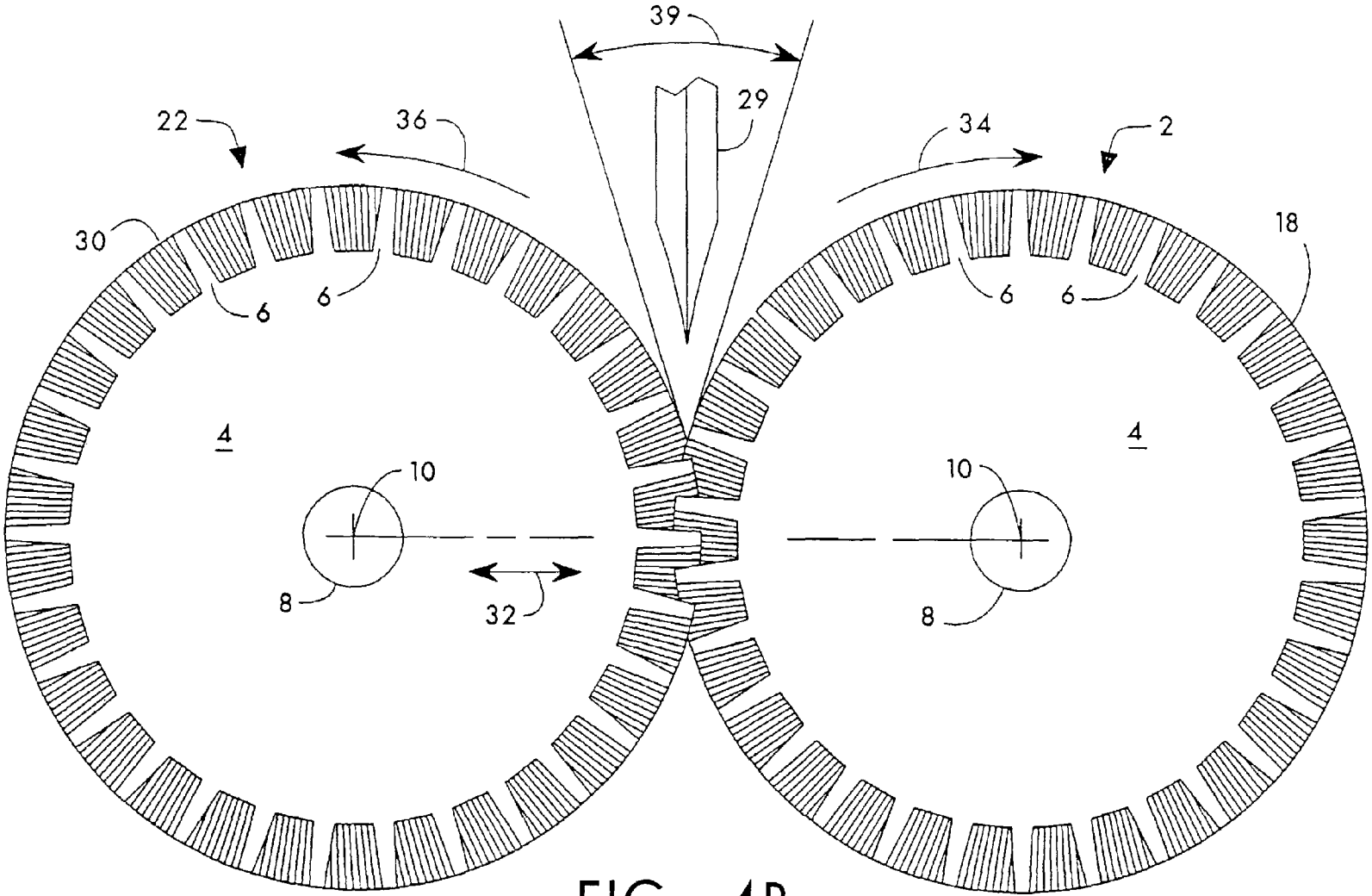

Referring to FIGS. 2-4B, the number of layers of disks used to make up the sharpening wheels can be varied, preferably there are eleven layers. The number of teeth on each disk can likewise be varied, preferably there are thirty teeth. Also, the offset 14 of adjacent teeth can be varied. Preferably the offset in each queue is uniformly 1.2 degrees which in the preferred embodiment axially aligns the L11 tooth of any given composite 18 with the L1 tooth of an immediately adjacent composite in the offset direction 16. This way there are no gaps in contact between the sharpening wheels and the edge being sharpened. FIGS. 4A and 4B best illustrate that when looking squarely at the faces of the sharpening wheels 2 & 22, adjacent composite teeth 18 overlap axially. This significantly reduces vibration or chatter that might otherwise be caused by having gaps in the grinding surfaces when sharpening a blade.

Preferably, the disks are thinner than as illustrated, thicker disks and teeth were drawn for clarity of illustration. Preferably the teeth are trapezoidal when viewed from the front, and have an apex face that is rectangular, approximately twice as long as they are thick.

Referring to FIG. 3B, a mating sharpening wheel, generally designated 22, is preferably made as a mirror image of the first sharpening wheel 2. Its layers consist of the same disks 4 as those in the first wheel 2. Also, the offset 14 between the tooth edges 12 of adjacent disks is the same as in first wheel. However, the disks are offset in an opposite angular direction from that of the first wheel. This creates a sharpening wheel with composite teeth 30 having a preferably uniform angular relationship to the wheel's axis which matches the angular relationship of the first wheel's composite teeth with the first wheel's axis, but in the opposite direction. In other words, the slopes of the composite teeth of the two wheels, i.e. the angle of a composite tooth with respect to its wheel's axis, are equal in amplitude, i.e. number of degrees, but opposite in sign, as best illustrated by comparing a composite 18 of FIG. 3A with corresponding composite 30 of FIG. 3B.

Referring again to FIGS. 1 and 2, the disks 4 are preferably made of a rigid material, preferably hardened steel which can be stamped from sheet stock relatively inexpensively. Once the disks have been stacked to form a sharpening wheel 2 (FIG. 3A) or its mirror image 22 (FIG. 3B) the disks are made to remain in fixed relation. This can be done by welding the disks together at several locations around the margins of the disks in the troughs between the composite teeth, or rivets can be used at several locations to hold the disks together in fixed relation. If rivets or another fastening through device is used, holes (not shown) for the fasteners are defined in the individual disks when they are made, and the holes are located to account for the angular offset between adjacent disks. The holes also serve to easily align the disks as they are stacked to assemble the sharpening wheels. After the wheels have been affixed to maintain their fixed relation, preferably a coating is applied to at least the apexes of the teeth to enhance the sharpening ability of the teeth. The coating is preferably cubic boron nitride or an equivalent coating such as BORAZON or a diamond coating. Such coatings are a fine, hard grit and can be applied according to conventional deposition methods. The coating greatly improves the ability of the coated teeth to cut and grind a blade into a finely sharpened edge.

Referring again to FIGS. 3A-4B, because sharpening wheel 22 is a mirror image of wheel 2, their composite teeth, 30 and 18 respectively, are able to intermesh cleanly when the wheels are engaged with the composite teeth of one wheel fitting in the trough between two composite teeth of the other wheel. When so engaged, the wheels can be rotated oppositely, at the same speed, and the composite teeth will remain engaged. The centered holes 8 allow the wheels to be mounted on of a pair of parallel, counter-rotating axles close enough for the wheels to mesh. Preferably the spacing between the axles is selectively adjusted over a range, as illustrated by the arrows 32 (FIGS. 4A and 4B). By this a user can set the wheels closer together or further apart depending on the desired grinding angle. Preferably the axles are counter-rotating toward a blade 28 being sharpened (wheel 2 in the direction of arrow 34 and wheel 22 in the direction of arrow 36) to avoid pulling the blade into the teeth during grinding.

Referring to FIGS. 4A and 4B, two different axles' spacings are illustrated. FIG. 4A illustrates two sharpening wheels of this invention which are almost fully intermeshed, while FIG. 4B illustrates two wheels which are intermeshed less than half way. Preferably the wheels can be moved from being fully intermeshed to at least being tangent to each other, although a more limited or expansive range may be used. By varying the degree of the wheels' intersection, the sharpening angle can also be varied. The "sharpening angle" is an included angle defined by tangents to each wheel originating at the point where the wheels separate in their rotation, i.e. the nadir of a V-shaped furrow between the wheels in which a blade's edge is inserted to be sharpened. FIGS. 4A and 4B illustrate blades, 28 and 29 respectively, entering respective sharpening furrows having differing included angles, 38 and 39 respectively. The included angle increases from zero degrees when the wheels are tangent (they do not intersect) to a maximum intersection limit which depends primarily on the length of the wheels' teeth, which also affects the number of teeth. The deeper the teeth intermesh, the greater the included angle. Preferably for general purpose knife blade sharpening, the sharpening wheels are about 4.5 inches in diameter and have thirty teeth approximately three-eights of an inch long. With these dimensions, the included angle of a sharp edge that can be ground into a blade is approximately 12° to 45°. This is a hollow-ground angle which puts the sharpest edge on the blade. Hollow-ground refers to a slightly concave shape of each ground surface of the blade adjacent to its sharpened edge, caused by the radius of the grinding wheels. A hollow ground blade is illustrated in FIG. 4A.

The counter-rotating axles are kept in synchronization by any conventional means, such as a motorized drive belt (not shown) sufficient to prevent variation in their rotation speeds and to rotate the wheels at high enough speeds, typically 2,800 to 6,300 r.p.m., to sharpen blades of various types, materials and thicknesses. The composite teeth of the two wheels, coated with a cutting compound, such as cubic boron nitride, easily and quickly forms sharp, burrless edges on the blades. With sharpening wheels of this configuration the sharpened edge can extend from the tip of the blade to its butt end, the end of the blade adjacent the knife's handle. This means the blade can be sharpened right up to the break-out where the sharp edge stops, proximate the butt end. The break-out is the end of the usable cutting edge. With other types of sharpeners the edge cannot be sharpened to the break-out without separate sharpening operations because the sharpening wheels do not intermesh.

Figure 6:
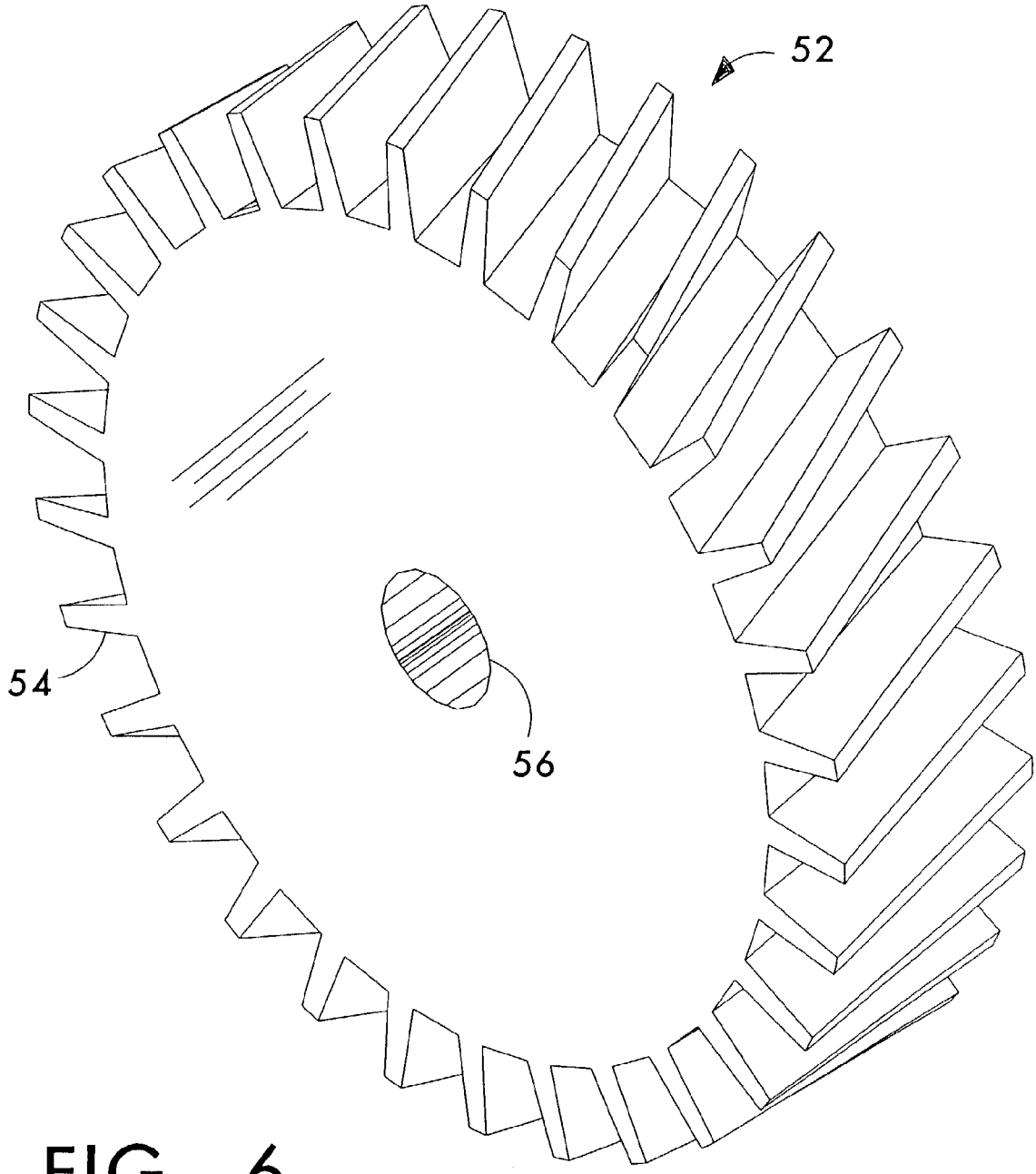
FIG. 6 is a pictorial view of a second embodiment of a sharpening wheel according to this invention.

Referring to FIG. 6, a second embodiment of the sharpening wheel generally designated 52 is illustrated to be solid, as opposed to stacked, having a plurality of uniformly spaced, elongated teeth 54 projecting radially from around its circumference. The wheel also preferably defines a mounting hole 56 concentric with the axis of the wheel. The teeth 54 of the solid wheel have basically the same axially elongated form as the composite teeth 18 (FIG. 2) and perform the same function. The teeth 54 are likewise angled and spaced around the circumference of the wheel 52. Preferably the wheel can have a selected axial thickness. Also, referring to FIGS. 4A and 4B, the stacked wheels illustrated therein can be replaced individually, or in pairs, by the solid wheels 52, and the above descriptions concerning how they cooperate and intermesh apply as well to the solid wheels or any mix of the solid wheels and the stacked wheels.

Figure 5:
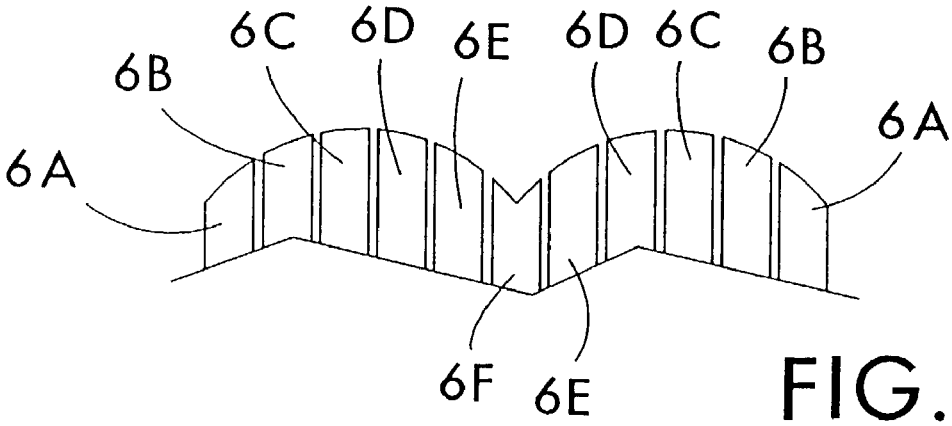
FIG. 5 is a partial edge view of a sharpening wheel in which the teeth of the individual disks are not of uniform dimension.

In alternate embodiments, sharpening wheels can be made to have non-uniform teeth lengths and/or sloping or curved apexes. FIG. 5 is but one example. FIG. 5 illustrates a composite tooth having a wave-like profile comprising two rises near opposite ends (the first rise being defined by teeth 6A though 6E, the second rise being defined by teeth 6E through 6A in opposite order), and a sharp middle valley (defined by tooth 6F). The sharpening wheels' teeth would be ground to the desired configuration prior to the application of a coating, such as cubic boron nitride. A pair of sharpening wheels having composite teeth with this profile can be used to produce a serrated blade edge by, for example, grinding the blade in increments along its length—after each increment is sharpened the blade is lifted away from the wheels and the next increment is then inserted into the grinding furrow, and so on. Alternatively, wider sharpening wheels 2 having additional layers of disks 4 can grind a serrated edge into a blade in a single operation. Alternatively, composite teeth can be made to have other profiles, for example: convex, concave, step-up, step-down, slanted, pointed, or any other desired simple or complex profile. Various blade edge profiles can be ground by sequentially grinding the blade at different positions along its edge to create various serration patterns. Although only a stacked wheel is illustrated in FIG. 5, it should be noted that solid wheels according to this invention can also be made to have selectively sloping or curved apex ridges.

The foregoing description and drawings were given for illustrative purposes only, it being understood that the invention is not limited to the embodiments disclosed, but is intended to embrace any and all alternatives, equivalents, modifications and rearrangements of elements.

The invention claimed is:

1. A blade sharpening wheel for mounting on a spindle comprising more than two concentrically stacked, circular disks, each disk including a plurality of radially projecting grinding teeth spaced around its circumference, the disks being in affixed relation to each other.

2. The wheel according to claim 1 wherein the disks are in angular offset relation to each other.

3. The wheel according to claim 1 wherein each disk includes a plurality of radially projecting teeth uniformly spaced around its circumference, the disks being aligned concentrically but progressively angularly offset one from another.

4. The wheel according to claim 3 wherein the teeth of the disks are aligned in rows which are angled with respect to the wheel's axis.

5. The wheel according to claim 4 wherein there is no axial gap between the tail end of a row of teeth and the front end of a preceding row of teeth.

6. The wheel according to claim 1 further comprising a coating adhered to the apexes of the teeth to enhance their cutting ability.

7. The wheel according to claim 6 wherein the coating comprises cubic boron nitride.

8. The wheel according to claim 1 wherein the lengths of the teeth are not uniform.

9. The wheel according to claim 8 wherein the apexes of each row of teeth define a curve.

10. A blade sharpening device comprising:

(a) a first wheel including a plurality of radial teeth;

(b) a second wheel including a plurality of radial teeth;

(c) two counter-rotating axles for respectively rotating the wheels, the teeth of the first wheel enmeshed with the teeth of the second wheel for sharpening a blade drawn against the teeth of the rotating wheels at an intersection of the wheels;

(d) each tooth of each wheel including an elongated, straight abrasive apex for scraping contact with a blade being sharpened;

(e) the abrasive apices of the first wheel being uniformly angular with respect to the first wheel's axis of rotation;

(f) the abrasive apices of the second wheel being uniformly angular with respect to the second wheel's axis of rotation.

11. The blade sharpening device according to claim 10 further comprising a coating of cubic boron nitride adhered to the apex of a tooth to enhance its cutting ability.

12. The blade sharpening device according to claim 10 wherein:

(a) the first wheel comprises a plurality of stacked circular disks, each disk, after the first, being concentrically stacked at an angular offset from a preceding disk, the offsets being in one direction; and (b) the second wheel comprises a plurality of stacked circular disks, each disk, after the first, being concentrically stacked at an angular offset from a preceding disk but in an offset direction opposite from the first wheel.

13. The blade sharpening device according to claim 10 wherein the amount the wheels' mesh is selectable over a range to vary accordingly the included angle of the sharpened edge of a blade.

14. The blade sharpening device according to claim 10 wherein the lengths of the teeth of the wheels are such that in cooperation they can sharpen a blade in serrated fashion.

15. A blade sharpening wheel comprising a plurality of concentrically stacked, circular disks, each disk including a plurality of radially projecting grinding teeth spaced around its circumference, the disks being in fixed relation to each other, the lengths of the teeth being not uniform.

16. The wheel according to claim 15 wherein the disks are in angular offset relation to each other.

17. The wheel according to claim 15 wherein each disk includes a plurality of radially projecting teeth uniformly spaced around its circumference, the disks being aligned concentrically but progressively angularly offset one from another.

18. The wheel according to claim 17 wherein the teeth of the disks are aligned in rows which are angled with respect to the wheel's axis.

19. The wheel according to claim 18 wherein there is no axial gap between the tail end of a row of teeth and the front end of a preceding row of teeth.

20. The wheel according to claim 15 further comprising a coating adhered to the apexes of the teeth to enhance their cutting ability.

21. The wheel according to claim 20 wherein the coating comprises cubic boron nitride.

22. The blade sharpening device according to claim 10 wherein the wheels are rotated in a direction opposing a blade being sharpened.

* * * * *